US008210820B2

(12) United States Patent
Arness et al.

(10) Patent No.: US 8,210,820 B2
(45) Date of Patent: Jul. 3, 2012

(54) GAS ASSISTED TURBINE SEAL

(75) Inventors: Brian P. Arness, Simpsonville, SC (US); John D. Ward, Woodruff, SC (US)

(73) Assignee: General Electric Company, Schenectady, NY (US)

( * ) Notice: Subject to any disclaimer, the term of this patent is extended or adjusted under 35 U.S.C. 154(b) by 1029 days.

(21) Appl. No.: 12/168,927

(22) Filed: Jul. 8, 2008

(65) Prior Publication Data

US 2010/0008783 A1 Jan. 14, 2010

(51) Int. Cl.
*F03B 3/12* (2006.01)

(52) U.S. Cl. ..... 416/219 R

(58) Field of Classification Search ..... 416/29 R
See application file for complete search history.

(56) References Cited

U.S. PATENT DOCUMENTS

| | | | | |
|---|---|---|---|---|
| 3,709,631 | A | 1/1973 | Karstensen et al. | |
| 4,326,835 | A * | 4/1982 | Wertz | 416/193 A |
| 4,422,827 | A | 12/1983 | Buxe et al. | |
| 4,480,957 | A | 11/1984 | Patel et al. | |
| 4,494,909 | A | 1/1985 | Forestier | |
| 4,725,200 | A | 2/1988 | Welhoelter | |
| 4,743,164 | A | 5/1988 | Kalogeros | |
| 4,743,166 | A | 5/1988 | Elston, III et al. | |
| 5,052,890 | A | 10/1991 | Roberts | |
| 5,052,893 | A | 10/1991 | Catte | |
| 5,139,389 | A | 8/1992 | Eng et al. | |
| 5,257,909 | A | 11/1993 | Glynn et al. | |
| 5,599,170 | A | 2/1997 | Marchi et al. | |
| 5,823,743 | A | 10/1998 | Faulkner | |
| 6,273,683 | B1 | 8/2001 | Zagar et al. | |
| 6,296,172 | B1 | 10/2001 | Miller | |
| 6,375,429 | B1 * | 4/2002 | Halila et al. | 416/193 A |
| 6,565,322 | B1 | 5/2003 | Lieser et al. | |
| 6,575,704 | B1 | 6/2003 | Tiemann | |
| 6,682,307 | B1 | 1/2004 | Tiemann | |
| 2009/0166988 | A1 | 7/2009 | Irmisch | |
| 2010/0068063 | A1 * | 3/2010 | Berg et al. | 416/223 A |

FOREIGN PATENT DOCUMENTS

| | | | |
|---|---|---|---|
| EP | 0774048 | A1 | 5/1997 |
| EP | 0799974 | | 10/1997 |
| EP | 1731714 | | 12/2006 |
| GB | 2224082 | | 4/1990 |
| WO | 9412772 | A1 | 6/1994 |
| WO | 00/75491 | | 12/2000 |

* cited by examiner

*Primary Examiner* — Richard Elms
*Assistant Examiner* — Harry W Byrne
(74) *Attorney, Agent, or Firm* — Sutherland Asbill & Brennan LLP

(57) ABSTRACT

A dovetail seal assembly for sealing a gap between a bucket dovetail and a rotor. The dovetail seal assembly may include a sealing slot positioned about the dovetail, a high-pressure supply hole in communication with the sealing slot, and a deformable seal positioned about the sealing slot and into the gap.

19 Claims, 3 Drawing Sheets

GAS ASSISTED TURBINE SEAL

TECHNICAL FIELD

The present application relates generally to any type of turbine and more particularly relates to systems and methods for sealing a gap formed between a turbine bucket dovetail and a turbine rotor via gas pressure and a deformable seal material.

BACKGROUND OF THE INVENTION

Gas turbines generally include a turbine rotor (wheel) with a number of circumferentially spaced buckets (blades). The buckets generally may include an airfoil, a platform, a shank, a dovetail, and other elements. The dovetail of each bucket is positioned within the turbine rotor and secured therein. The airfoils project into the hot gas path so as to convert the kinetic energy of the gas into rotational mechanical energy. A number of cooling medium passages may extend radially through the bucket to direct an inward and/or an outward flow of the cooling medium therethrough.

Leaks may develop in the coolant supply circuit based upon a gap between the tabs of the dovetails and the surface of the rotor due to increases in thermal and/or centrifugal loads. Air losses from the bucket supply circuit into the wheel space may be significant with respect to blade cooling medium flow requirements. Moreover, the air may be extracted from later compressor stages such that the penalty on energy output and overall efficiency may be significant during engine operation.

Efforts have been made to limit this leak. For example, one method involves depositing aluminum on a dovetail tab so as to fill the gap at least partially. Specifically, a circular ring may be pressed against the forward side of the dovetail face. Although this design seals well and is durable, the design cannot be easily disassembled and replaced in the field. Rather, these rings may only be disassembled when the entire rotor is disassembled.

There is thus a desire for improved dovetail tab sealing systems and methods. Such systems and methods should adequately prevent leakage therethrough so as to increase overall system efficiency while being installable and/or repairable in the field.

SUMMARY OF THE INVENTION

The present application thus provides a dovetail seal assembly for sealing a gap between a bucket dovetail and a rotor. The dovetail seal assembly may include a sealing slot positioned about the dovetail, a high-pressure supply hole in communication with the sealing slot, and a deformable seal positioned about the sealing slot and into the gap.

The present application further provides a dovetail seal assembly for sealing a gap between a bucket dovetail and a rotor. The dovetail seal assembly may include a sealing slot positioned about the dovetail, a supply chamber positioned about the sealing slot, a supply hole in communication with the supply chamber and a high pressure side of the dovetail, and a deformable seal positioned about the sealing slot and forced into the gap via high pressure air passing from the high pressure side of the dovetail into the supply hole.

The present application further provides a method of sealing a gap between a bucket dovetail and a rotor. The method includes the steps of positioning a deformable seal within a sealing slot of the dovetail, forcing high-pressure fluid through the dovetail, and forcing the deformable seal against the rotor with the high-pressure fluid.

These and other features of the present application will become apparent to one of ordinary skill in the art upon review of the following detailed description when taken into conjunction with the several drawings and the appended claims.

DETAILED DESCRIPTION

Figure 1A:
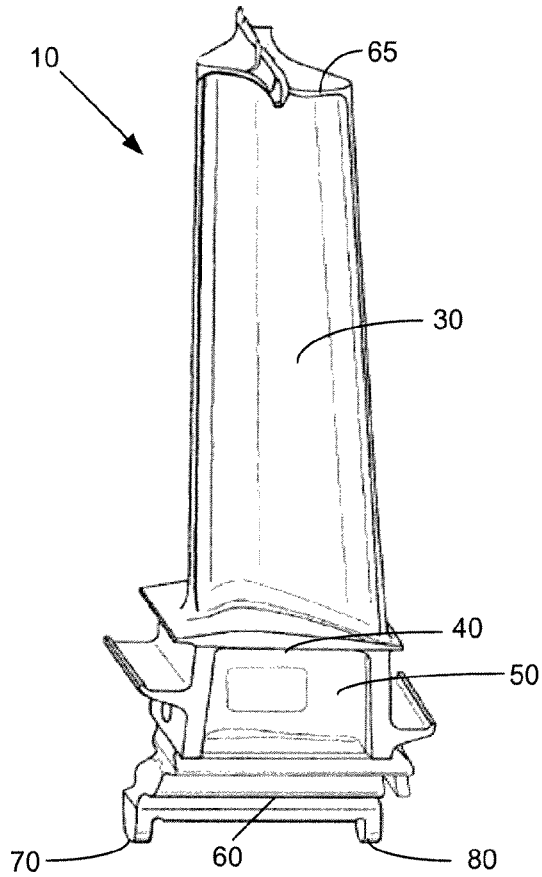
FIG. 1A is a perspective view of a bucket with a shroud that may be used with the sealing systems as are described herein.
Figure 2:
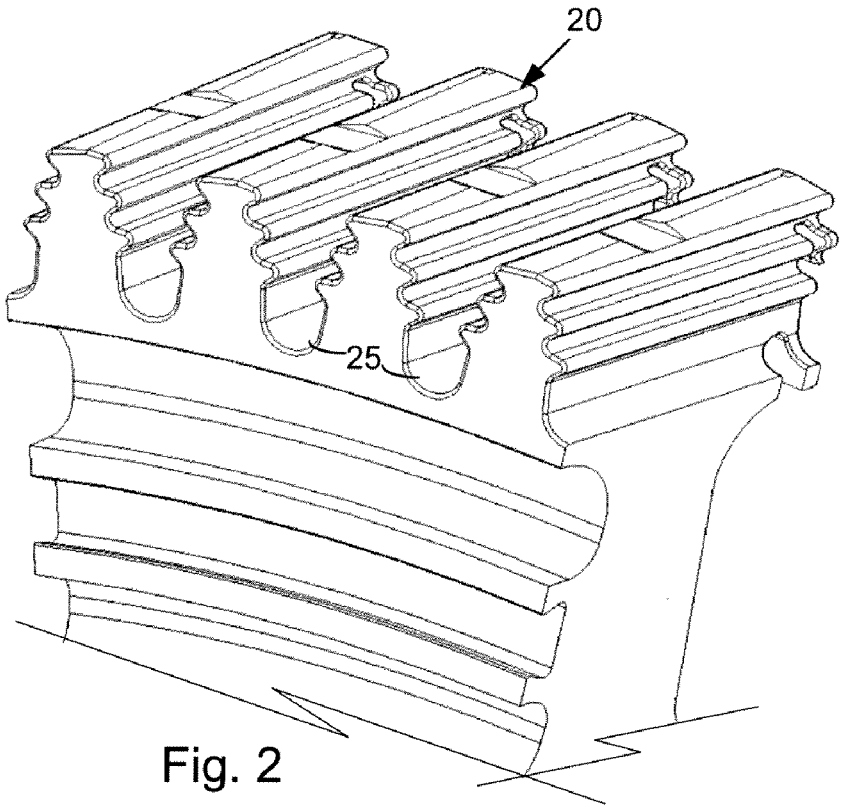
FIG. 2 is a perspective view of a rotor.

Referring now to the drawings, in which like numerals refer to like elements throughout the several views, FIG. 1A shows a bucket 10 as may be used herein. The bucket 10 may be a first or a second stage bucket as used in a 7FA+e gas turbine sold by General Electric Company of Schenectady, N.Y. Any other type of bucket or stage also may be used herein. The bucket 10 may be used with a rotor 20 as is shown in FIG. 2.

Figure 1B:
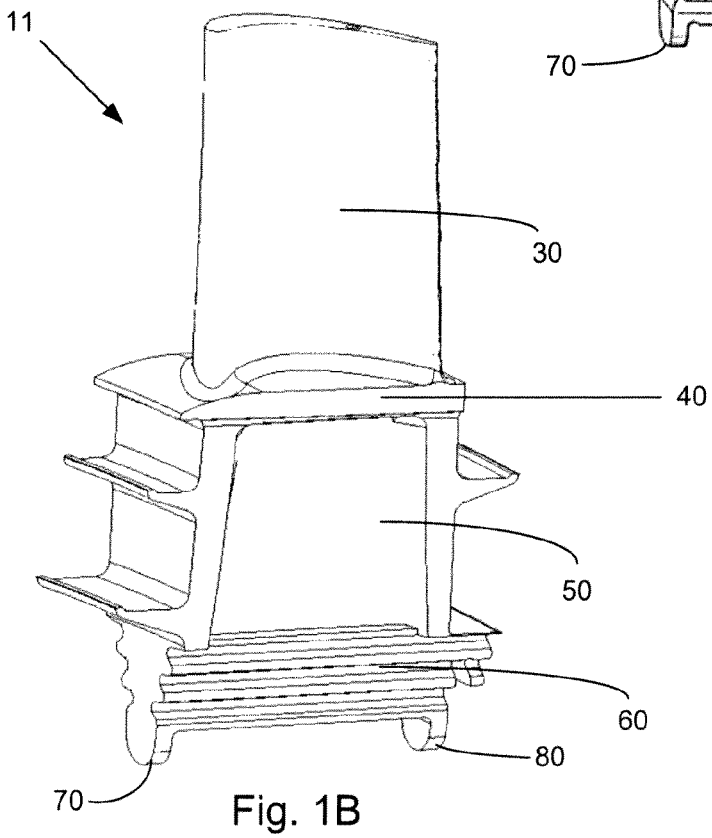
FIG. 1B is a perspective view of a bucket without a shroud that may be used with the sealing systems as are described herein.

As is known, the bucket 10 may include an airfoil 30, a platform 40, a shank 50, a dovetail 60, and other elements. It will be appreciated that the bucket 10 is one of a number of circumferentially spaced buckets 10 secured to and about the rotor 20 of the turbine. The bucket 10 of FIG. 1A has a shroud 65 on one end of the airfoil 30. The bucket 11 of FIG. 1B lacks the shroud. Any other type of bucket design may be used herein.

As described above, the rotor 20 may have a number of slots 25 for receiving the dovetails 60 of the buckets 10. Likewise, the airfoils 30 of the buckets 10 project into the hot gas stream so as to enable the kinetic energy of the stream to be converted into mechanical energy through the rotation of the rotor 20. The dovetail 60 may include a first tang or tab 70 and a second tab 80 extending therefrom. Similar designs may be used herein. A gap 90 may be formed between the ends of the tabs 70, 80 of the dovetail 60 and the rotor 20. A high pressure cooling flow may escape via the gap 90 unless a sealing system of some type is employed.

Figure 3:
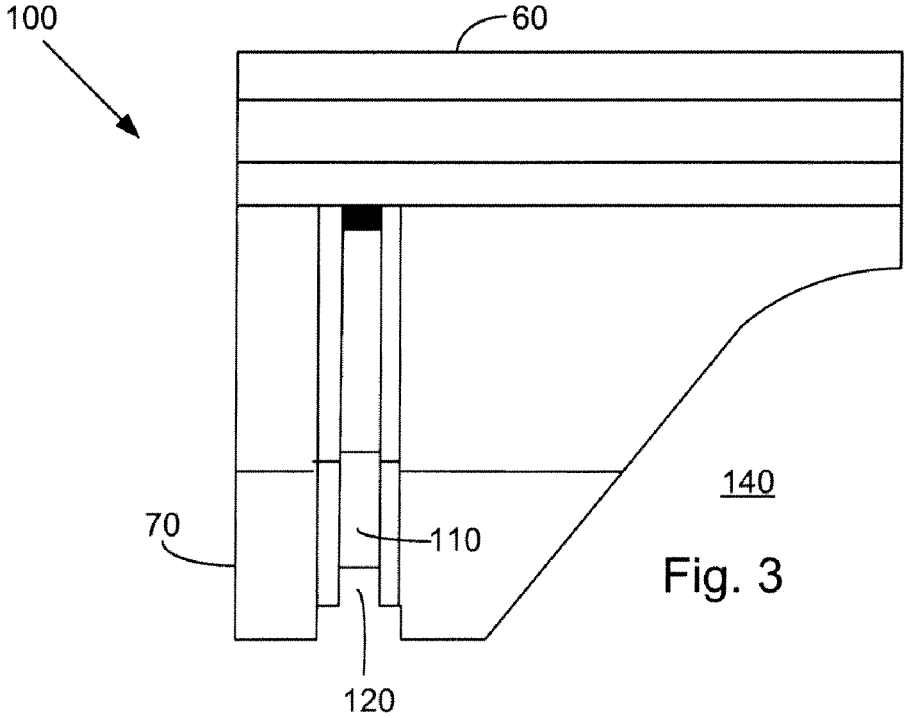
FIG. 3 is a side plan view of a sealing slot of a sealing system as is described herein.
Figure 4:
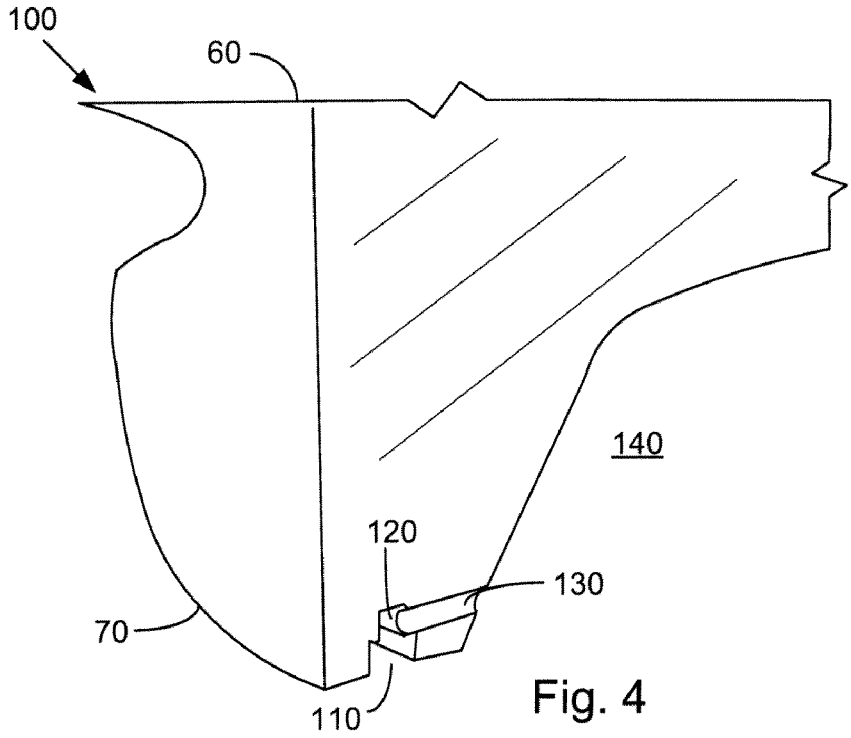
FIG. 4 is a side cross-sectional view of the sealing slot and a high-pressure supply hole of the sealing system as is described herein.
Figure 5:
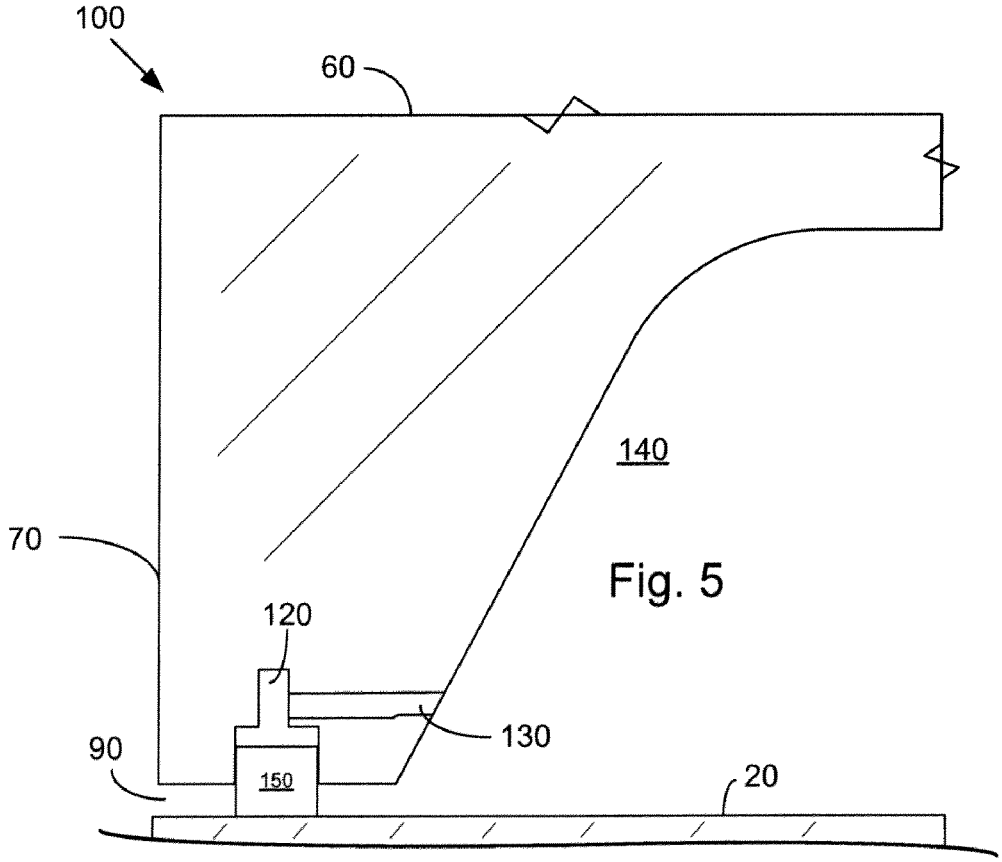
FIG. 5 is a side cross-sectional view of the sealing system as is described herein.

FIGS. 3-5 show a dovetail seal assembly 100 as is described herein. The dovetail seal assembly 100 may be positioned about and within the first tab 70 of the dovetail 60 of the bucket 10. The dovetail seal assembly 100 may include a sealing slot 110. The sealing slot 110 may extend about the perimeter of the first tab 70. The dimensions and shape of the sealing slot 110 may vary, in whole or in part, about the tab 70. The sealing slot 110 may be formed with conventional machining techniques. Other types of manufacturing techniques also may be used herein.

The dovetail seal assembly 100 may include a high-pressure supply chamber 120 positioned about the first tab 70 directly above the sealing slot 110. The high-pressure supply chamber 120 also may extend about the perimeter of the first tab 70 and may have any desired size or shape. The high-pressure supply chamber 120 also may be formed by conventional machining or other types of manufacturing techniques. A deeper sealing slot 110 may be used in place of a specific high-pressure supply chamber 120.

The dovetail seal assembly 100 may include a high-pressure supply hole 130 in communication with the high-pressure supply chamber 120. The high-pressure supply hole 130 extends from the high-pressure supply chamber 120 to the exterior of the first tab 70 about a high-pressure side 140 thereof. The high-pressure supply hole 130 may have any desired geometry or size. The high-pressure supply hole 130 also may be formed by conventional machining or other types of manufacturing techniques.

The dovetail seal assembly 100 may include a deformable seal 150 positioned about the sealing slot 110. The deformable seal 150 may have a substantially square cross-section, a nearly circular cross-section, a "c"-shape, or any other desired design. Specifically, an axial or a radial c-seal may be used. The deformable seal 150 may be made out of a woven graphite, woven metal, woven intermetallic, woven ceramic, sintered metal/graphite, vapor deposited graphite on a metal backing, hybrids of metal/graphite/ceramics, and other types of deformable materials. The deformable seal 150 may fill the sealing slot 110 as well as the gap 90 between the bucket 10 and rotor 20. Any number of seals 150 and supply holes 130 may be used herein.

In use, high-pressure air or other fluids from the high-pressure side 140 of the first tab 70 of the dovetail 60 extends into the high-pressure supply hole 130 and the high-pressure supply chamber 120. The high-pressure air presses or exerts a force against the deformable seal 150. The deformable seal 150 thus is forced against the rotor 20 such that the gap 90 is filled and high-pressure air is not allowed to leak therethrough. Specifically, the compressive force or other force on the deformable seal 150 counteracts the centrifugal loading force present as the bucket 10 rotates. The deformable seal 150 seals the gap 90 in whole or in part. Other types of sealing forces may be used herein.

The deformable seal 150 also may be used with other sealing systems and methods. The dovetail seal assembly 100 also may be used with the second tab 80 and elsewhere.

It should be apparent that the foregoing relates only to certain embodiments of the present application and that numerous changes and modifications may be made herein by one of ordinary skill in the art without departing from the general spirit and scope of the invention as defined by the following claims and the equivalents thereof.

We claim:

1. A dovetail seal assembly for sealing a gap between a bucket dovetail and a rotor, comprising:

a sealing slot positioned in a radial plane about the dovetail;

a deformable seal positioned in a radial plane about the sealing slot and into the gap; and a high-pressure supply hole in communication with the sealing slot such that the high-pressure pressure supply hole supplies an inward compressive force on the deformable seal that counteracts a centrifugal load force due to rotation and forces the deformable seal towards the rotor and into the gap.

2. The dovetail seal assembly of claim 1, further comprising a high-pressure supply chamber positioned between the sealing slot and the high-pressure supply hole.

3. The dovetail seal assembly of claim 1, wherein the sealing slot extends about a perimeter of a tab of the dovetail in whole or in part.

4. The dovetail seal assembly of claim 3, wherein the sealing slot comprises a variable depth about the perimeter of the tab of the dovetail in whole or in part.

5. The dovetail seal assembly of claim 1, wherein the high-pressure supply hole communicates with a high-pressure side of the dovetail.

6. The dovetail seal assembly of claim 1, wherein the deformable seal comprises a metallic, a ceramic, or a hybrid seal.

7. The dovetail seal assembly of claim 1, wherein the deformable seal comprises a substantially square cross-section.

8. The dovetail seal assembly of claim 1, wherein the deformable seal comprises a substantially circular cross-section.

9. The dovetail seal assembly of claim 1, wherein a high-pressure fluid creates the inward compressive force.

10. A dovetail seal assembly for sealing a gap between a bucket dovetail and a rotor, comprising:

a sealing slot positioned in a radial plane about the dovetail;

a supply chamber positioned in a radial plane about the sealing slot;

a supply hole in communication with the supply chamber and a high pressure side of the dovetail; and a deformable seal positioned in a radial plane about the sealing slot and forced into the gap via an inward compressive force way of high-pressure air passing from the high-pressure side of the dovetail into the supply hole, wherein the compressive force counteracts a centrifugal load force due to rotation and forces the deformable seal towards the rotor and into the gap.

11. The dovetail seal assembly of claim 10, wherein the sealing slot extends about a perimeter of a tab of the dovetail in whole or in part.

12. The dovetail seal assembly of claim 11, wherein the sealing slot comprises a variable depth about the perimeter of the tab of the dovetail in whole or in part.

13. The dovetail seal assembly of claim 10, wherein the deformable seal comprises a metallic, a ceramic, or a hybrid seal.

14. The dovetail seal assembly of claim 10, wherein the deformable seal comprises a substantially square cross-section.

15. The dovetail seal assembly of claim 10, wherein the deformable seal comprises a substantially circular cross-section.

16. A method of sealing a gap between a bucket dovetail and a rotor, comprising:

positioning a deformable seal within a sealing slot of the dovetail;

forcing high-pressure fluid through the dovetail;

providing an inward compressive force on the deformable seal that counteracts a centrifugal load force due to rotation; and forcing the deformable seal towards the rotor and into the gap with the high-pressure fluid.

17. The method of claim 16, further comprising machining the sealing slot into the dovetail.

18. The method of claim 16, further comprising machining a supply hole into the dovetail.

19. The method of claim 16, further comprising sealing the gap with the deformable seal in whole or in part.

* * * * *